United States Patent [19]

Schleppinghoff et al.

[11] Patent Number: 4,950,820

[45] Date of Patent: Aug. 21, 1990

[54] PROCESS FOR THE HYDROGENATION OF OLEFINIC HYDROCARBONS IN HYDROCARBON MIXTURES CONTAINING TERT--ALKYL ALKYL ETHERS

[75] Inventors: Bernhard Schleppinghoff, Dormagen; Horst Reinhardt, Bergheim; Hans-Joachim Krämer, Dormagen, all of Fed. Rep. of Germany

[73] Assignee: EC Erdolchemie GmbH, Cologne, Fed. Rep. of Germany

[21] Appl. No.: 885,042

[22] Filed: Jul. 14, 1986

[30] Foreign Application Priority Data

Jul. 24, 1985 [DE] Fed. Rep. of Germany ..... 3526443

[51] Int. Cl.[5] ..... C07C 5/02

[52] U.S. Cl. ..... 585/264; 585/3; 585/270; 585/276; 585/277

[58] Field of Search ..... 585/3, 264, 269, 270, 585/276, 277

[56] References Cited

U.S. PATENT DOCUMENTS

| | | | |
|---|---|---|---|
| 3,077,733 | 2/1963 | Axe et al. | 585/270 |
| 3,098,106 | 7/1963 | Edwards | 585/270 |
| 3,549,720 | 12/1970 | Wright et al. | 585/260 |
| 3,679,762 | 7/1972 | La Hue et al. | 585/260 |
| 4,224,458 | 9/1980 | Grey et al. | 585/274 |
| 4,546,204 | 10/1985 | Parris | 585/314 |
| 4,558,168 | 12/1985 | Gusson et al. | 585/314 |

FOREIGN PATENT DOCUMENTS

| | | | |
|---|---|---|---|
| 248010 | 8/1960 | Canada | 585/260 |
| 0049803 | 4/1982 | European Pat. Off. . | |
| 1560586 | 3/1969 | France . | |
| 2097016 | 3/1972 | France . | |
| 1361671 | 7/1974 | United Kingdom | 585/269 |

*Primary Examiner*—Asok Pal

*Attorney, Agent, or Firm*—Sprung Horn Kramer & Woods

[57] ABSTRACT

Olefinic hydrocarbons present in mixtures containing tert.-alkyl alkyl ethers and, if appropriate, other saturated aliphatic or aromatic hydrocarbons can be hydrogenated with substantial preservation of the ethers if the catalyst used has an active component for hydrogenation on a catalyst support having a specific surface area of more than 50 $m^2/g$ and a pore diameter of, in the main, $<1,000$ nm.

17 Claims, 1 Drawing Sheet

PROCESS FOR THE HYDROGENATION OF OLEFINIC HYDROCARBONS IN HYDROCARBON MIXTURES CONTAINING TERT.-ALKYL ALKYL ETHERS

The present invention relates to a process for the hydrogenation of olefinic hydrocarbons present in a mixture with tert.-alkyl alkyl ethers and, if appropriate, other saturated aliphatic or aromatic hydrocarbons, in which process the tert.-alkyl alkyl ethers remain substantially preserved, and to the use of the mixtures obtained in this hydrogenation process.

In order to raise the octane number, it is possible to add to automotive gasolines tert.-alkyl alkyl ethers, the best-known representatives of these being methyl tert-. butyl ether (MTBE) and tert.-amyl methyl ether (TAME). Ethers of this type are generally prepared by etherifying tertiary alkenes in gasoline fractions and other suitable starting materials by means of lower alkanols, over acid catalysts, such as cation exchangers, sulphuric acid and other acid catalysts.

The ether-containing reaction mixtures formed in this process still contain major amounts of olefinic hydrocarbons which impair the quality of these mixtures as additives to automotive gasoline, particularly if they are to be added to non-leaded gasoline. A marked improvement in quality, for example an increase in the motor octane number (MON), a decrease in the sensitivity =interval between MON and research octane number (RON)) and an improvement in stability on storage could be expected by subjecting ether-containing reaction mixtures of this type to a hydrogenative -treatment.

Numerous processes, in which various catalysts are employed, are known for the hydrogenation of olefins or hydrocarbon mixtures containing olefins. These hydrogenation catalysts contain, as the active component for hydrogenation, one or more elements of the 6th, 7th or 8th subgroup of the periodic system of the elements in elementary or combined form, and these can be doped with various additives in order to obtain specific catalyst properties, such as prolongation of working life, resistance to certain catalyst poisons, increase in selectivity or improved capacity for regeneration. Hydrogenation catalysts of this type frequently contain the active component for hydrogenation on supports, such as mordenites, zeolites, Al2O3 modifications, SiO2 modifications and others. In general, reaction temperatures of 150–250° C. are used to achieve substantial hydrogenation of the olefins.

On the other hand, it is known that tert.-alkyl alkyl ethers are re-cleaved into alkanols and tert.alkenes at a reaction temperature as low as 90° C. on acid catalysts including, not only acid cation exchangers, but also mordenites, zeolites, various $Al_2O_3$ modifications, various SiO2 modifications and others. It is also known that oligomeric tertiary alkenes can also be cleaved on acid catalysts, for example those mentioned.

A process has now been found for the hydrogenation of olefinic hydrocarbons in mixtures with tert.-alkyl alkyl ethers and, if appropriate, other saturated aliphatic, naphthenic or aromatic hydrocarbons, with substantial preservation of the ethers, which is characterized in that a catalyst which has an active component for hydrogenation on a catalyst support having a specific surface area of more than 50 $m^2/g$ and a pore diameter of, in the main, < 1,000 nm is used.

Elements of the 6th, 7th or 8th subgroup of the periodic system of the elements, such as molybdenum, rhenium, iron, cobalt, nickel or the platinum metals, are suitable for use as the active component for hydrogenation. The platinum metals, especially platinum and/or palladium and very particularly palladium, are employed in a concentration of 1–50 g/l of catalyst, in particular 5–20 g/l of catalyst. The other elements mentioned, especially cobalt, nickel and/or molybdenum, very particularly nickel, are employed in a concentration of the active component for hydrogenation, calculated as metal, of 200–800 g/l, in particular 300–700 g/l, of catalyst. The other metals mentioned, not included amongst the platinum metals, can also be employed in a combined form.

The support materials used for the hydrogenation catalysts to be employed in accordance with the invention H can be materials having a specific surface area >50 $m^2/g$ of catalyst, but particularly .>100 $m^2/g$ of catalyst, and a pore diameter in the main <1,000 nm, but particularly in the main <200 nm.

Materials of this type can, for example, be predominantly neutral aluminium silicates, kieselguhrs, $Al_2O_3$, charcoals and the like, provided that they meet the above conditions. Kieselguhrs and $Al_2O_3$ are particularly suitable.

Support materials, such as $SiO_2$ or acid aluminium silicates, are also suitable if they have been doped with alkali or alkaline earth metal compounds. A suitable concentration fOr the a1kali or alkaline earth metal compounds is O.OI-1 equivalents, preferably 0.02–0.2 equivalents of alkali/alkaline earth meta( per (itre o& catalyst. The predominantly neutral supports mentioned above can also receive doping of this type.

The hydrogenation according to the invention is possible either in the trickle phase or in the liquid or gaseous phase, and is generally carried out at a temperature of 50–200° C., preferably 80–180° C. and particularly preferably 100–150° C.

The partial pressure of hydrogen is generally adjusted to 1–100 bar, preferably 2–40 bar, and particularly preferably 5–30 bar.

The hydrogen employed can be pure hydrogen, industrial hydrogen or the hydrogen-containing residual gas available in petrochemical plants. The hydrogen conL tent therein is 70–100%, often even about 80 to about 90%. The impurities present in industrial hydrogen and in hydrogen-containing residual gases are, for example, nitrogen, methane or ethane. In the process according to the invention the amount of hydrogen is adjusted to such a figure that the degree of residual unsaturation corresponds to the desired value. In order to achieve this residual degree of unsaturation use is also made of the reaction temperature and/or the dwell time in the hydrogenation reactor in a manner which is known to those skilled in the art in this respect it is frequently possible to use an excess of hydrogen, which is removed after the hydrogenation reaction or is used as circulation gas. The residual degree of unsaturation is determined by the bromine number in g of $Br_2$/100 g of hydrocarbon mixture. Bromine numbers above 50, even above 70, g of $Br_2$/100 g of hydrocarbon mixture can be reduced in accordance with the invention through all conceivable intermediate values down to values of less than 5, even down to <0.01, g of $Br_2$/100 g of hydrocarbon mixture. The content of tert.-alkyl alkyl ether iS substantially preserved in this reaction. Substantial preservation is to be understood as meaning, for example, the preservation of at least 90% of the original content of ether, in many cases more than 96% of the ether.

The catalyst loading in the process according to the invention is 1–5 l of the material employed per l of catalyst and hour for operation in the liquid phase and the trickle phase. For operation ih the gas phase, the catalyst loading is 2–3 l/l of catalyst and hour.

The heat formed in the reaction can be removed by cooling the reactor or by means of the sensible heat of the reaction product. In order to avoid temperature peaks, the feed material can be diluted by recycling part of the hydrogenated product to the feed material.

Suitable feed materials for the process according to the invention are those containing tert.-alkyl alkyl ethers as well as olefinic, paraffinic, naphthenic or aromatic hydrocarbons and, if necessary, minor amounts of diolefins. Mixtures of this type are obtained, for example, when gasoline fractions, obtained, for example, from a steam cracker, a fluid catalyst cracker (FCC) or dehydrogenation plants are reacted with lower alkanes. Suitable gasoline fractions are those which are suitable for subsequent use in automotive gasoline by virtue of their C number range. Examples of tert.-alkyl alkyl ethers in mixtures of this type which may be mentioned are those derived from tertiary $C_4$-$C_8$-alkenes and $C_1$-$C_4$-alcohols. Particular mention may be made of the ethers of tertiary $C_4$-$C_6$-alkenes with methanol, especialty the ethers of tertiary $C_5$-$C_6$-alkenes with methanol. of tertiary After the process according to the invention has been carried out excess hydrogen which may be present is removed as residual gaS, together with accompanying substances, such as methane, ethane or nitrogen and other low-boilers.

The hydrogenation product according to the invention which is available after a residual gas has been removed can be used as an additive to automotive gasoline. The invention also relates, therefore, expressly to this use.

The separation of the hydrogenation mixture obtainable in accordance with the invention can, of course, also be effected by a procedure in which, in a distillation column, an automotive gasoline fraction is obtained which does not contain a tert.-alkyl alkyl ether and from which the residual gas still has to be removed, a pure ether, for example TAME, is obtained as a side-stream, and small amounts of higher-boilers, such as higher ethers and oligomers, remain in the sump.

EXAMPLES

The present invention is illustrated by means of the following examples. Customary hydrogenation apparatus is used in these (FIGS. 1, 2 and 3). In principle, the test set-up was identical for the hydrogenations; the only difference was the direction of flow through the hydrogenation reactor, which was arranged upwards in the case of liquid phase hydrogenation and was arranged downwards in the cases of gas phase hydrogenation and trickle phase hydrogenation.

DESCRIPTION OF TEST

The feed material for all the tests described below was a $C_5$–$C_6$ hydrocarbon fraction from a previously hydrogenated pyrolysis gasoline which had been subjected to etherification with methanol and consequently contained tert.-amyl methyl ether (TAME) and tert.-hexyl methyl ether. This feed material had a composition with the following characteristic features:

bromine number: 80 g of $Br_2$/100 g

TAME: 15% by weight tert.-hexyl methyl ether: 2% by weight

Figure 1:
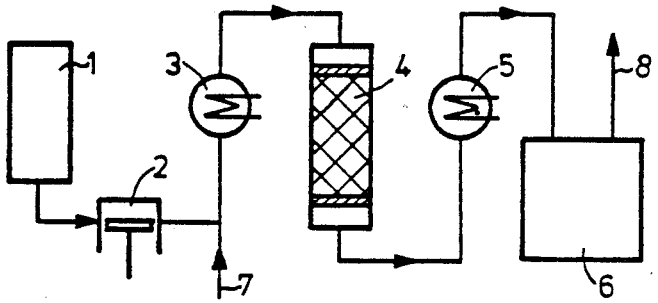
FIG. 1 shows a test set up for a gas phase hydrogen and trickle phase hydrogenation.
Figure 2:
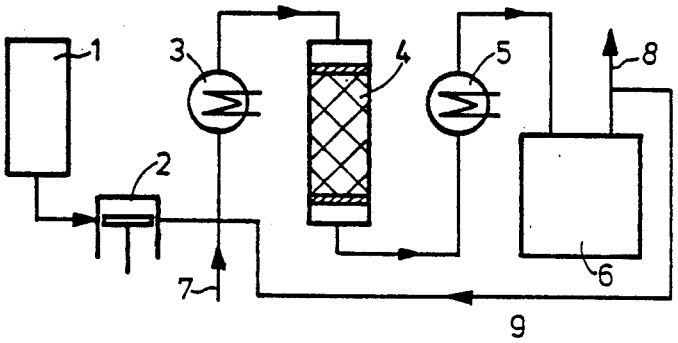
FIG. 2 shows a test set up as in FIG. 1 with a recirculation line.
Figure 3:
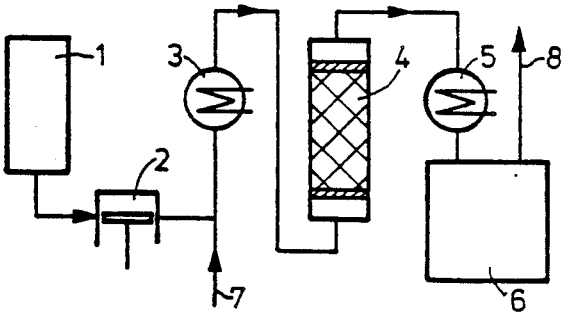
FIG. 3 shows a test set up for a liquid phase hydrogenation.

The test apparatus (FIG. 1: hydrogenation in the trickle phase, FIG. 2: gas phase hydrogenation and FIG. 3: hydrogenation in liquid phase) was composed of the following units:

The feed material was conveyed from a graduated feed vessel (1) by means of a piston pump (2) via the preheater (3) into the hydrogenation reactor (4). The latter consisted of a thermostatically controlled double jacket of the following dimensions: internal diameter 25 mm and length 750 mm. The hydrogenation catalyst (250 ml) was arranged as a fixed bed and was enclosed at the top and at the bottom by a packing of ceramic spheres (each 50 mm in length). The hydrogen (7) (approx. 80% by volume of $H_2$; approx. 20% by volume of $CH_4$) was metered into the feed material before the preheater (3). The hydrogenated product passed via the cooler (5) into the separator (6). The exit gas rate (8) (mainly $H_2$ and $CH_4$) was 200 Nl/hr.

As a variant of this description, in tests in which the feed material was rediluted, the feed material was blended with the hydrogenated product in a ratio of 2 parts of feed material to 1 part of hydrogenated product. In the gas phase hydrogenation a circulation line (9) was employed in addition in order to recirculate to the fresh hydrogen (7), part of the $H_2$ residual as (8) obtained in the separator (6). In this variant the preheater (3) was additionally employed as a vaporizer and the cooler (5) was additionally employed as a condenser. In the hydrogenation in the liquid phase, the flow through the hydrogenation reactor (4) was upward Valves and also measuring and control devices known to those skilled in the art are not shown in FIG. 1, 2 and 3.

TEST CONDITIONS

In liquid phase and trickle phase hydrogenation, the following reaction conditions were established for all the catalysts employed

| |
|---|
| temperature of feed material 60° C. and |
| maximum reactor temperature 100° C. |
| or |
| temperature of feed material 100° C. and |
| maximum reactor temperature 150° C. |
| reaction pressure 25 bar |
| $H_2$ exit gas rate 200 Nl/hr. |
| catalyst loading (expressed as liquid hourly space velocity LHSV) 2 l/l of catalyst.hr. |

As a variant of this, in the gas phase hydrogenation the reaction pressure was adjusted to 2 bar at a reactor temperature of 100° C. and to 5 bar at a reactor temperature of 150° C. The circulation as rate was 500 Nl/ hr in the gas phase hydrogenation.

TEST RESULTS

The effect of the hydrogenation was assessed by means of the bromine number and the TAME content after the hydrogenation of the alkenes in the feed material, for reactor temperatures of 100 and 150° C. The catalysts employed for the hydrogenation are shown in Table 1. The results of each hydrogenation are shown in Table 2 as a function of the catalysts mentioned in Table 1.

TABLE 1

Examples 1 to 13 (catalysts)

| Example No. | Active component for hydrogenation: Type | Active component for hydrogenation: Concentration, g/l of catalyst | Catalyst Support: Type | Catalyst Support: Shape | Catalyst Support: Dimensions, mm | Catalyst Support: Specific surface area, $m^2/g$ | Catalyst Support: Pore diameter >1000 nm % | Catalyst Support: 200–1,000 nm % | Catalyst Support: <200 nm % | Additional doping: Type | Additional doping: Concentration mol/l of catalyst |
|---|---|---|---|---|---|---|---|---|---|---|---|
| 1 | Pd | 18 | $\alpha$-$Al_2O_3$ | Spheres | 4–6 | 9 | 92 | 8 | 0 | — | — |
| 2 | Ni | 410 | Al silicate | Tablets | 3 × 3 | 140 | 60 | 40 | 0 | Co. | 0.7 |
| 3 | Ni | 200 | Ceramics | Spheres | 2.4–4 | <10 | 90 | 10 | 0 | — | — |
| 4,4a, 4b | Pd | 5 | $\delta$-$Al_2O_3$ | Spheres | 4–6 | 79 | 15 | 47 | 38 | — | — |
| 5 | Pd | 18 | $\delta$-$Al_2O_3$ | Spheres | 2.4–4 | 79 | 15 | 47 | 38 | — | — |
| 6 | Pd | 18 | $\delta$-$Al_2O_3$ | Spheres | 4–6 | 250 | 33 | 26 | 41 | — | — |
| 7 | Pd | 20 | Charcoal | Extrudate | 2 × 1.5 | >1000 | 5 | 15 | 80 | — | — |
| 8 | Ni | 68 | Kieselguhr | Tablet | 3 × 3 | 125 | — | 3 | 97 | — | — |
| 9 | Ni | 65 | Kieselguhr | Tablet | 3 × 3 | 158 | — | — | 100 | — | — |
| 10,10a | Ni | 60 | Kieselguhr | Tablet | 3 × 3 | 110 | — | 20 | 80 | — | — |
| 11 | Pd | 18 | $\gamma$-$Al_2O_3$ | Spheres | 4–6 | 250 | 33 | 26 | 41 | Li | 0.14 |
| 12 | Pd | 18 | $\gamma$-$Al_2O_3$ | Spheres | 4–6 | 250 | 33 | 26 | 41 | Na | 0.04 |
| 13 | Pd | 18 | $\gamma$-$Al_2O_3$ | Spheres | 4–6 | 250 | 33 | 26 | 41 | K | 0.03 |

Examples no. 1–3 with high portions of pore diameter >1000 nm are comparison examples.

TABLE 2

Examples 1 to 13 (reaction conditions and results)

| Example No. | Type of reaction: Gas phase (G) Liquid phase (L) Trickle phase (T) | Reaction temperature, °C. | Results of hydrogenation: Bromine number g of $Br_2/g$ | Results of hydrogenation: TAME, % by weight | Remarks |
|---|---|---|---|---|---|
| 1 | L | 100 | <0.01 | 15.0 | |
| | | 150 | <0.01 | <1.0 | |
| 2 | L | 100 | 0.1 | 13.5 | |
| | | 150 | 0.2 | <1.0 | |
| 3 | L | 100 | 5 | 15.0 | |
| | | 150 | 2 | 4.0 | |
| 4 | L | 100 | <0.01 | 15.0 | |
| | | 150 | <0.01 | 14.0–15.0 | |
| 4a | L | 100 | <0.01 | 15.0 | Re-dilution: 2 parts by volume of starting material + 1 part by volume of hydrogenated product |
| | | 150 | <0.01 | 15.0 | |
| 4b | T | 100 | <0.01 | 15.0 | |
| | | 150 | <0.01 | 4.0 | |
| 5 | L | 100 | <0.01 | 15.0 | |
| | | 150 | <0.01 | 15.0 | |
| 6 | L | 100 | <0.1 | 15.0 | |
| | | 150 | <0.1 | 15.0 | |
| 7 | L | 100 | <0.1 | 15.0 | |
| | | 150 | <0.01 | 15.0 | |
| 8 | L | 100 | <0.1 | 15.0 | |
| | | 150 | <0.01 | 15.0 | |
| 9 | L | 100 | <0.1 | 15.0 | |
| | | 150 | <0.01 | 15.0 | |
| 10 | L | 100 | <0.1 | 15.0 | |
| | | 150 | <0.01 | 15.0 | |
| 10a | G | 150 | <0.1 | 15.0 | |
| | | 100 | <0.01 | 15.0 | |
| 11 | L | 100 | 0.2 | 15.0 | |
| | | 150 | 0.1 | 15.0 | |
| 12 | L | 100 | <0.1 | 15.0 | |
| | | 150 | <0.1 | 15.0 | |
| 13 | L | 100 | <0.01 | 15.0 | |
| | | 150 | <0.01 | 15.0 | |

We claim:

1. A process for the hydrogenation of a gasoline fraction suitable for use in automotive gasoline wherein said gasoline fraction contains olefinic hydrocarbons and tert.-alkyl alkyl ethers with substantial preservation of the ethers, wherein said hydrogenation is conducted in the presence of a catalyst which has an active component for hydrogenation on a catalyst support having a specific surface area of more than 50 $m^2/g$ and a pore diameter of, in the main, 1,000nm.

2. A process according to claim 1, wherein the active component for hydrogenation is at least one noble metal of the 8th subgroup of the periodic system of the elements and the concentration of noble metal is 1–50 g/l of catalyst.

3. A process according to claim 1, wherein the active component for hydrogenation is cobalt, nickel, molybdenum or mixtures thereof in elementary or combined form, and the concentration of the active components for hydrogenation, calculated as metal, is 200–800 g/l.

4. A process according to claim 1, wherein the support material is selected from aluminium silicates, kieselguhrs, charcoal or $Al_2O_3$.

5. A process according to claim 1, wherein the specific surface area of the catalyst support is $>100\ m^2/g$.

6. A process according to claim 1, wherein the pore diameter of the catalyst support is, in the main, $<200$ nm.

7. A process according to claim 1, wherein the support material or the catalyst is doped with alkali or alkaline earth metal compounds, the concentration being 0.01–1 equivalent of alkali/alkaline earth metal per litre of catalyst.

8. A process according to claim 1, wherein the hydrogenation is carried out at a reaction temperature of 50–200° C, and under an $H_2$ partial pressure of 1–100 bar.

9. A process according to claim 1, the feed material used is hydrocarbon mixtures containing the methyl ether of isobutene and/or of the tert.-amylenes and/or of the tert.-hexenes.

10. A process according to claim 2, wherein the active component for hydrogenation is platinum and/or palladium.

11. A process according to claim 2, wherein the concentration of noble metal is 5–20 g/L of catalyst.

12. A process to claim 3, wherein the concentration of the active components for hydrogentaion, calculated as metal, is 300–700 g/L of catalyst.

13. A process according to claim 4, wherein the support material is selected from kieseIguhr and $Al_2O_3$.

14. A process according to claim 8, wherein the hydrogenation is carried out at a reaction temperature of 80–180° C.

15. A process according to claim 8, wherein the hydrogenation is carried out at a reaction temperature of 80–180° C. under an $H_2$ partial pressure of 2–40 bar.

16. A process according to claim 9, wherein the feed material used is pyrolysis gasoline fractions containing methyl ethers of tert.-amylenes and/or of tert.-hexenes.

17. A process according to claim 1, wherein the mixture which is hydrogenated also contains saturated aliphatic, naphthenic or aromatic hydrocarbons.

* * * * *